US007430944B1

(12) United States Patent
Miller

(10) Patent No.: US 7,430,944 B1
(45) Date of Patent: Oct. 7, 2008

(54) WING NUT INSTALLATION CLUTCH DRIVE DEVICE

(76) Inventor: Terry G. Miller, 381 Wyler St., Port Charlotte, FL (US) 33954

( * ) Notice: Subject to any disclaimer, the term of this patent is extended or adjusted under 35 U.S.C. 154(b) by 0 days.

(21) Appl. No.: 11/606,483

(22) Filed: Nov. 30, 2006

(51) Int. Cl.
*B25B 23/143* (2006.01)
*B25B 13/48* (2006.01)

(52) U.S. Cl. ..... 81/467; 81/124.2

(58) Field of Classification Search ..... 81/124.2, 81/125, 176.1, 176.2, 438, 467, 900
See application file for complete search history.

(56) References Cited

U.S. PATENT DOCUMENTS 3,151,512 A * 10/1964 Charczenko ..... 81/176.2
4,215,600 A * 8/1980 Kesselman ..... 81/471
4,357,845 A * 11/1982 Cornia ..... 81/125
4,823,650 A 4/1989 Tuttle
4,825,732 A 5/1989 Arnold
5,176,050 A 1/1993 Sauer et al.
5,216,781 A * 6/1993 Brondfield ..... 16/426
5,297,458 A * 3/1994 Smith et al. ..... 81/124.3
5,697,268 A 12/1997 Makovsky et al.
6,138,538 A 10/2000 Neijndorff
6,330,846 B1 12/2001 Strauch
6,439,086 B1 8/2002 Bahr
6,588,306 B1 * 7/2003 Grossman et al. ..... 81/467
6,715,384 B1 4/2004 Kozak
6,886,434 B2 5/2005 Hu
6,922,887 B1 * 8/2005 Keswani ..... 29/757
7,069,820 B2 * 7/2006 Goacher, Sr. ..... 81/124.2
7,293,482 B1 * 11/2007 Wolf et al. ..... 81/124.2
2005/0120838 A1 * 6/2005 Gottlieb et al. ..... 81/452

* cited by examiner

*Primary Examiner*—David B Thomas
(74) *Attorney, Agent, or Firm*—Charles J. Prescott

(57) ABSTRACT

A wing nut installation clutch drive device and method of installing and removing a hurricane shutter. An elastomeric body includes a bore extending longitudinally therethrough for tightly frictionally receiving a drive shaft, a portion of the length of which is tightly frictionally engaged in the bore wherein a rotational force applied by a drive motor engaged with an exposed portion of the drive shaft is translated to the body. A cavity is formed into a distal end of the body adapted to biasingly engage over a wing nut including the hub and wing members thereof whereby the rotational force is applied to install and tighten the wing nut or to loosen and remove the wing nut from threaded engagement with a threaded shaft of each of a plurality of bolts used to retain the shutter without damaging or over tightening the wing nut. An anti-slip improved bolt head of the bolt is also provided.

2 Claims, 3 Drawing Sheets

WING NUT INSTALLATION CLUTCH DRIVE DEVICE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to socket and drive mechanisms and more particularly to an elastomeric clutch drive device for installing and removing installation bolt wing nuts in conjunction with attaching a hurricane shutter against a building.

2. Description of Related Art

Hurricane shutters are typically installed against a building over a window or door opening of a building in the face of a hurricane threat by the use of wing nuts which facilitate hand installation absent the availability of tools. These wing nuts are generally hand tightenable sufficiently to retain the hurricane shutter onto installation bolts having heads slidably engaged within either an upright or horizontal track or channel attached to the building. However, when a conventional hard steel wing nut driver operated by wrench or a power drill is used, wing nut fracture or thread striping is very likely. Moreover, should an extra strong pair of hands or a hand tool be used to either tighten or loosen the wing nuts, the wings which laterally extend from the threaded hub of the wing nut can break off, leaving the further removal thereof from the installation bolt very annoying at best. Moreover, the installation bolts are intended to be freely slidably engageable within these tracks, inadvertent movement, especially within the vertical track may make positioning of the holes formed through the perimeter frame of the hurricane shutter which must be aligned with all of the installation bolts a difficult task. Therefore, a drive tool which engages over each of the wing nuts and which will torsionally drive the wing nuts on and off the threaded shaft of each of the installation bolts on a torque limiting basis is needed and not found in prior art.

U.S. Pat. No. 6,886,434 to Hu teaches a wrench with a fixed maximum operational torque utilizing elastic member (31). A torque-limiting device is disclosed by Bahr, in U.S. Pat. No. 6,439,086 and Strauch discloses a chuck with an elastic element formed as a bending spring in U.S. Pat. No. 6,330,846.

A tool for the application of selected torque teaches the material of the tool more readily deformable than material of the component so that the wrench deforms the second portion when encountering resistance to further rotation in U.S. Pat. No. 5,176,050 to Sauer, et al. Neijndorff discloses a finish-protective tool collar made from non-marring materials in U.S. Pat. No. 6,138,538.

U.S. Pat. No. 4,823,650 to Tuttle discloses a power driven wrench for fastening wing nuts and U.S. Pat. No. 6,715,384 teaches a fastener driver for wing nuts with second portion (14) having a tendency to flex and deform when transferring a rotational force to a fastener.

Other patents located of interest in the search are U.S. Pat. No. 4,825,732 to Arnold, U.S. Pat. No. 4,581,962 to Marbourg, U.S. Pat. No. 5,009,133 to Carey and U.S. Pat. No. 5,697,268 to Makovsky, et al.

The present invention provides not only an improved elastomeric clutch drive device which prevents overtightening of the wing nuts causing either stripping of the threads within the hub of the wing nut or the fracture of the wings away from the body, but also an improved installation bolt for hurricane shutters which is resistive to inadvertent sliding movement when held within the channels attached to the building to which the hurricane shutter is to be temporarily attached prior to hurricane conditions.

BRIEF SUMMARY OF THE INVENTION

This invention is directed to a wing nut installation clutch drive device and method of installing and removing a hurricane shutter. An elastomeric body includes a bore extending longitudinally therethrough for tightly frictionally receiving a drive shaft, a portion of the length of which is tightly frictionally engaged in the bore wherein a rotational force applied by a drive motor engaged with an exposed portion of the drive shaft is translated to the body. A cavity is formed into a distal end of the body adapted to biasingly engage over a wing nut including the hub and wing members thereof whereby the rotational force is applied to install and tighten the wing nut or to loosen and remove the wing nut from threaded engagement with a threaded shaft of each of a plurality of bolts used to retain the shutter without damaging or over tightening the wing nut. An anti-slip improved bolt head of the bolt is also provided.

It is therefore an object of this invention to provide an installation clutch drive device embodying an elastomeric body which engages over each of the wing nuts used to install hurricane shutters and which avoids any substantial risk of overtightening or fracturing of the wings of the wing nut.

Yet another object of this invention is to provide an improved method of installing and removing hurricane shutters.

Still another object of this invention is to provide an improved installation bolt which, when frictionally slidably held within the support channels for attaching the hurricane shutters, resist inadvertent movement as a result of vibration or gravity while positioning the mounting holes in the frame of the hurricane shutter over each of the installation bolts.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 5:
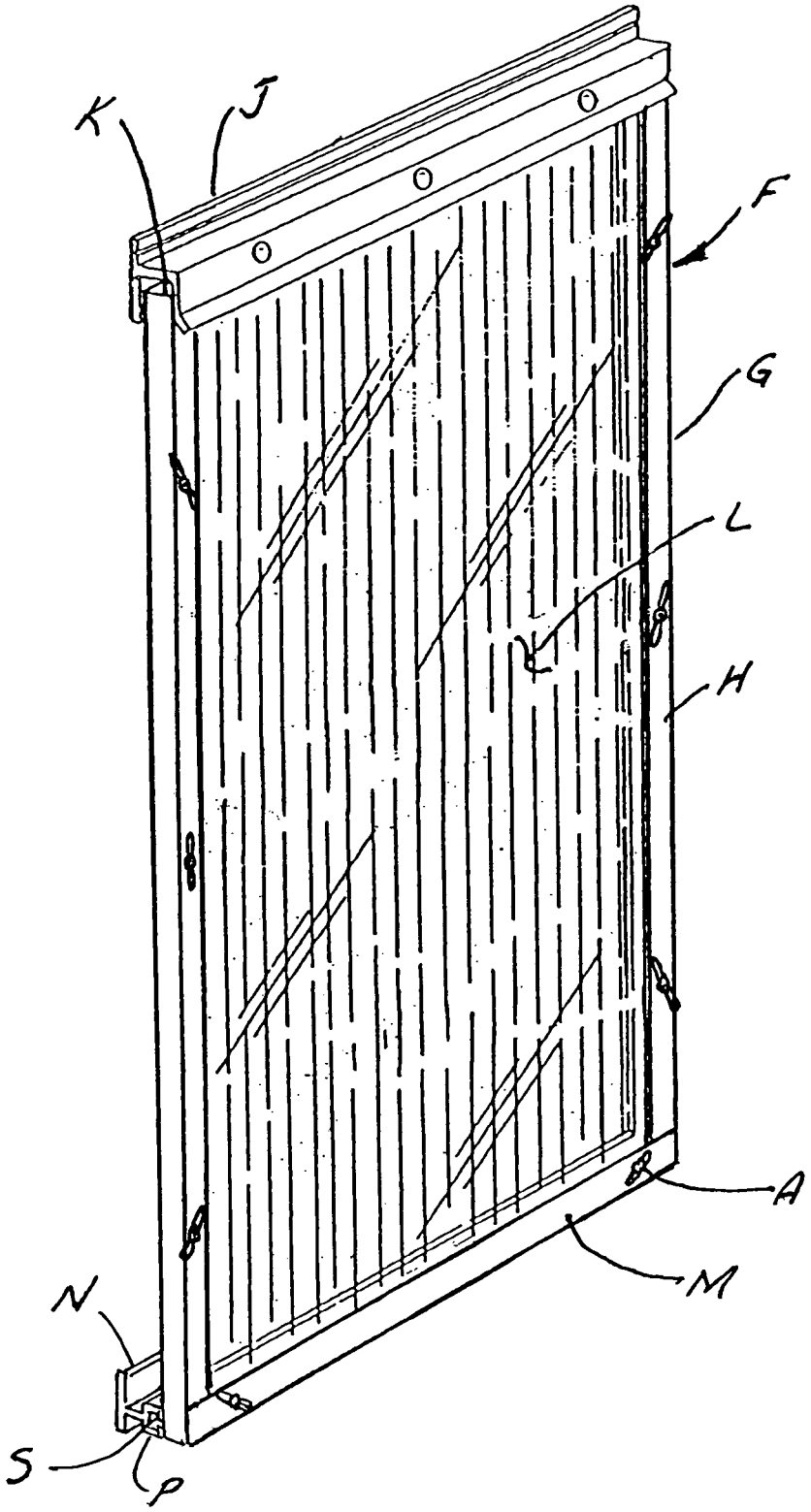
FIG. 5 is a perspective view of a typical hurricane shutter installation.
Figure 6:
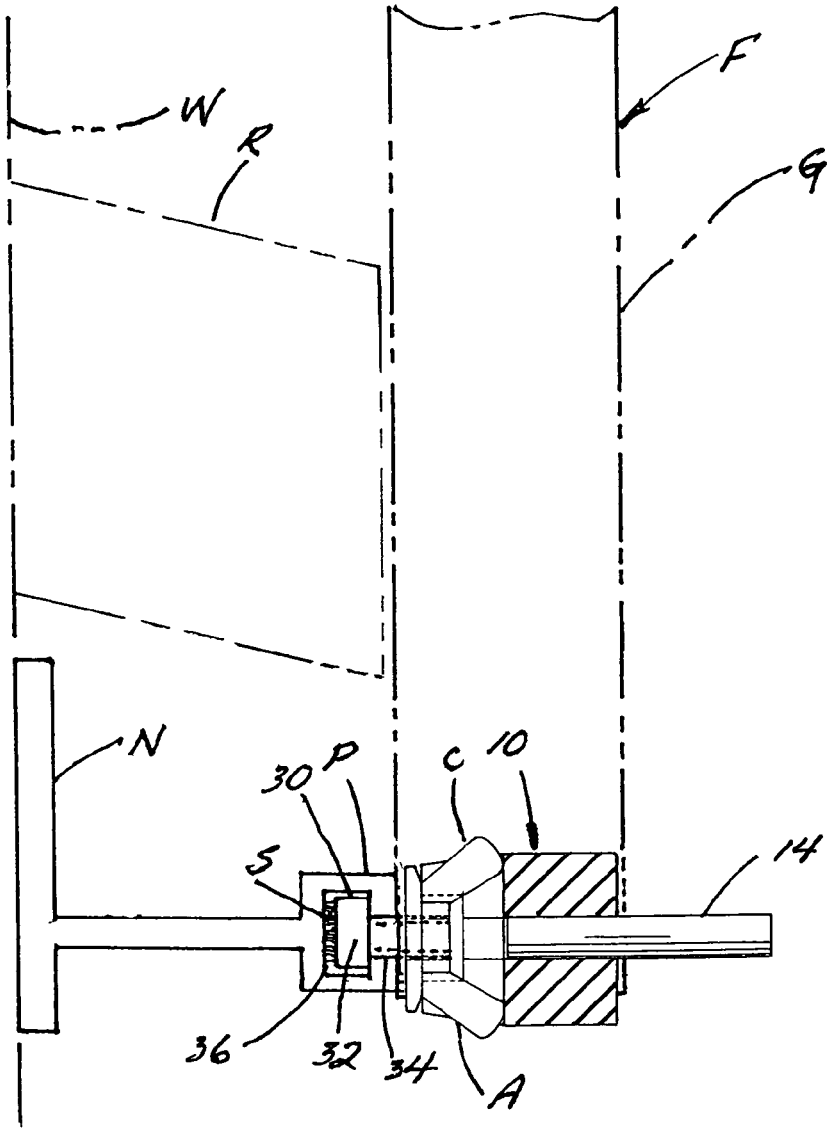
FIG. 6 is an enlarged side elevation partial section view of the lower horizontal support F-track and shutter (in phantom) of FIG. 5.

Referring now to the drawings, the preferred embodiment of the invention is there shown generally at numeral 10 while a typical hurricane shutter installation onto a building surrounding a window to be protected is shown generally at F in FIGS. 5 and 6. The installation clutch drive device 10 includes a preferably cylindrically shaped elastomeric body 12 formed of rather hard rubber material preferably having a durometer or hardness reading of in the range of 90 dur. The body 12 includes a longitudinal cylindrical bore 16 which is sized slightly smaller in a diameter than that of the outside diameter of a drive shaft 14, the drive shaft 14 being partially inserted into the bore 16 such that an exposed portion of the drive shaft 14 is engagable into the chuck of a rotational driving device such as a portable drill motor.

By carefully determining the relationship between the elastomer hardness forming the body 12 and the interference fit between the bore 16 and the drive shaft 14, a predictable level of rotational force transfer between the drive shaft 14 and the body 12 is established. Typically, an interference fit of about 0.02" to 0.12" is preferred which establishes a reasonable range of rotational force transfer to effect the wing nut driving performances described herebelow. Note that texturing or knurling may be added to the surface of the drive shaft 14 which would accelerate wear of bore 16.

Formed into the distal end 22 of the body 12 is a cavity 18 including a transverse slot 20 which matably engage over the main threaded body D and wings C of a conventional wing nut A. Again, an interference fit between the cavity 18 and transverse slot 20 against the corresponding surfaces of the wing nut A are designed into the cavity and slot configuration, depending upon the dimensional features of the wing nut A. Preferably an interference fit in the range of 0.02" to 0.12", in combination with the firmness range of 70 dur. to 90 dur. of the body 12 produce an acceptable biased frictional engagement which retains the wing nut A within the cavity 18 during bolt attachment and removal or unthreading of the wing nut A from threaded engagement over a threaded shaft 34 of each of the installation bolts 30 described herebelow.

Figure 1:
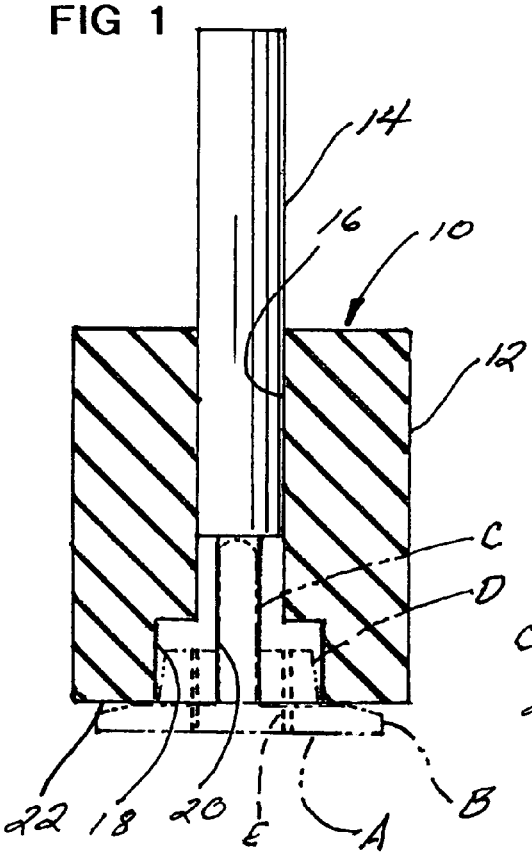
FIG. 1 is a side elevation section view of the invention showing a typical wing nut engaged therewith in phantom.
Figure 2:
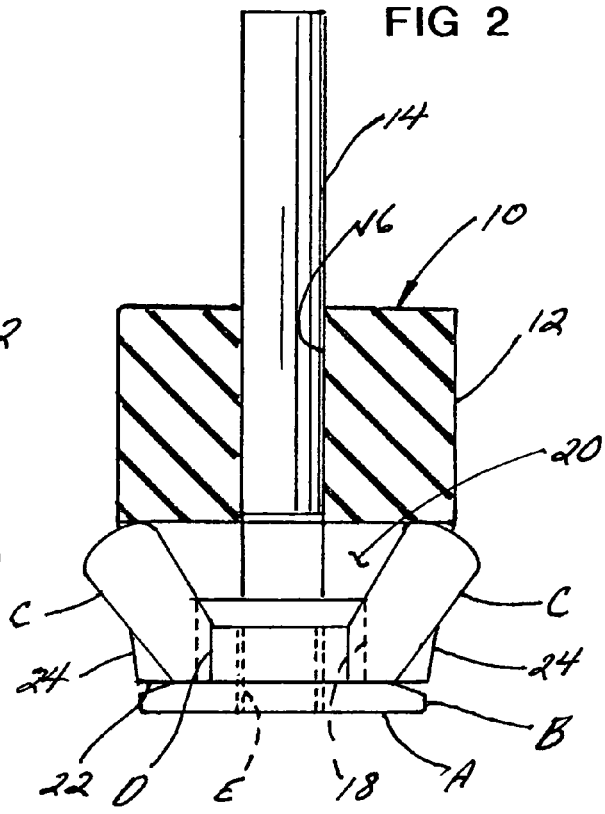
FIG. 2 is another side elevation section view orthogonally oriented to that of FIG. 1 showing the engagement with the wing nut.
Figure 3:
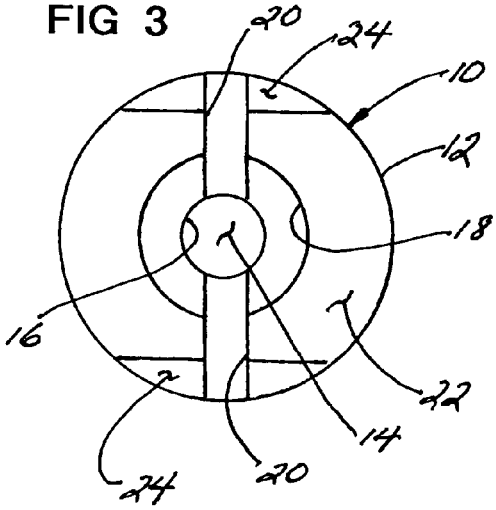
FIG. 3 is a bottom plan view of FIG. 1 absent the wing nut for clarity.
Figure 4:
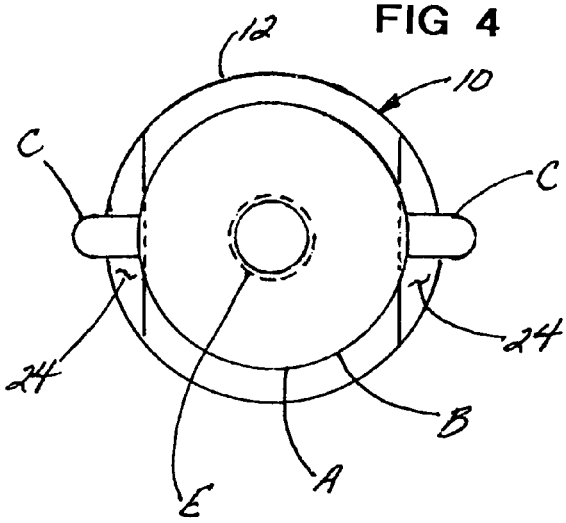
FIG. 4 is a bottom plan view of FIG. 2.

When fully inserted into the cavity 18 including the aligned transverse slot 20, the base B of the wing nut A comes in contact against the distal end 22 of body 12 as best seen in FIGS. 1 and 2. When the wing nut A is thus inserted into frictional biased engagement with the body 12, two important features of the invention not only prevent over tightening of the wing nut A, but also help insure that over torquring either during installation or removal of the wing nut A will not cause damage or fracture of the wings C away from the hub D. First, should the drill motor be inherently capable of delivering more rotational torque than the wings C can absorb without fracture, the frictional limiting feature between the drive shaft 14 and bore 16 as previously described, limit the rotational force delivery amount into the wing nut A when full engagement condition is present. Further, should the rotational force delivery feature between the drive shaft 14 and bore 16 become excessive for any reason whatsoever, the distal portion of the body 12, including the slot 20, will expand radially outwardly, stretching to release and become disengaged from the wings C in any overtorquing situation.

As seen in FIGS. 5 and 6, the body 12 is easily engagable when supported on the drive shaft 14 lockably engaged within the drive chuck of a drill motor (not shown for clarity) over the wing nut A and its wings C. During removal of the hurricane shutter F, the wing nuts A are simply removed by the device 10 one at a time by the insertion of each wing nut A into the cavity 18 and slot 20. Then, by counter rotating the drill motor, each wing nut A is unthreaded from the threaded shaft 34 of each installation bolt 30.

The heads 32 of each bolt 30 are held within an elongated channel S formed as a part of an elongated extruded F-track N which is rigidly connected to the wall W of a building. Each F-track N is horizontally elongated as shown in FIG. 5 in an appropriate amount to position the track S away from the wall W to accommodate the sill R immediately beneath each window. The frame G which is lockably engaged by its upper transverse frame member K into a downwardly U-shaped channel J is then held against or immediately adjacent to the wall W of the building by each of the installation bolts 30 being inserted through mating apertures or mounting holes formed through the perimeter frame G in the spaced relation shown. Thereafter, one wing nut A is threadably engaged over each threaded shaft 34 which outwardly protrudes from the outer surface of the perimeter frame G.

Figure 8:
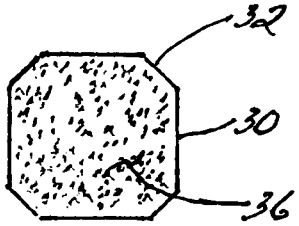
FIG. 8 is an end elevation view of FIG. 7.
Figure 7:
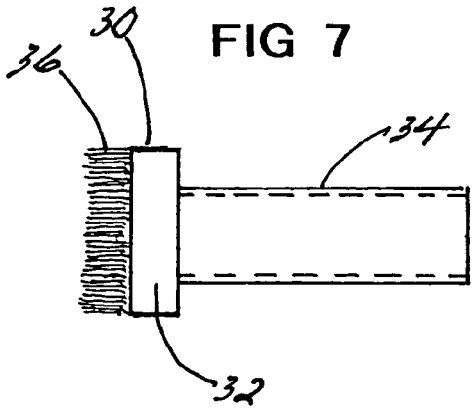
FIG. 7 is a side elevation view of an improved installation bolt of the invention.

Because the installer must align each of the threaded shafts 34 of each of the installation bolts 30 properly to fit through the installation holes formed in the perimeter G of the hurricane shutter F simultaneously as the shutter is pivotally moved inwardly at its lower margin M into contact against the track P, an improved anti-slide feature of the installation bolt 30 shown in FIGS. 6, 7 and 8 is also provided. A compressible resilient fiber pad 36 preferably in the form of one part of a two-part VELCRO attaching system is adhesively attached to the head 30 as shown. The overall width of the head 30 and fiber pad 36 is greater than the depth of the channel S such that a frictional compressibility of the fiber pad 36 is created as the head 30 with fiver pad 36 attached is slidably engaged into the channel S of track P. Easily overcome by manual movement, each installation bolt 30 is then positionable within the corresponding vertical and horizontal tracks S in alignment with the corresponding hole formed through the perimeter frame G to greatly facilitate the installation positioning of the hurricane shutter F over each of the installation bolts 30 so that each of the threaded shafts 34 outwardly extend beyond the outer surface of the perimeter G for ready to receive wing nut installation utilizing the device 10 as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A wing nut installation clutch drive device comprising:

an elastomeric body having a bore extending longitudinally therethrough;

a drive shaft, a portion of the length of which is frictionally engaged in said bore to transfer to said elastomeric body a predetermined limited rotational force applied by a drive motor engaged with an exposed portion of said drive shaft wherein relative rotation of said drive shaft in said bore occurs above the predetermined limited rotational force;

a cavity formed into a distal end of said body adapted to biasingly engage over a wing nut including the hub and wing members thereof whereby the rotational force is applied to install and tighten the wing nut or to loosen and remove the wing nut from threaded engagement with a threaded shaft of a bolt without damaging or over tightening the wing nut.

2. A wing nut installation dutch drive device as set forth in claim 1, further comprising:

a plurality of installation bolts, each of said bolts including an enlarged head formed at one end of a threaded shaft, said head being slidably engageable within a support channel attached to a building onto which the hurricane shutter is installed and a compressible resilient fiber pad attached onto each said head wherein the overall thickness of said head and fiber pad is greater than a depth of the support channel whereby each said bolt is biasingly held from inadvertent movement within the channel.

* * * * *

UNITED STATES PATENT AND TRADEMARK OFFICE

CERTIFICATE OF CORRECTION

PATENT NO. : 7,430,944 B1
APPLICATION NO. : 11/606483
DATED : October 7, 2008
INVENTOR(S) : Terry G. Miller It is certified that error appears in the above-identified patent and that said Letters Patent is hereby corrected as shown below:

Column 5, line 5, “dutch” should be changed to --clutch--.

Signed and Sealed this

Twenty-fifth Day of November, 2008

JON W. DUDAS
*Director of the United States Patent and Trademark Office*